United States Patent [19]

Grebe et al.

[11] 4,000,861

[45] Jan. 4, 1977

[54] VACUUM FOOD MILL

[75] Inventors: Ludwig Grebe, Wallau, Lahn; Reiner Grebe, Biedenkopf, Lahn, both of Germany

[73] Assignee: Kraemer & Grebe GmbH & Co KG Maschinen- und Modellfabrik, Wallau, Lahn, Germany

[22] Filed: May 22, 1975

[21] Appl. No.: 579,828

[30] Foreign Application Priority Data

May 24, 1974 Germany ..... 2425142

[52] U.S. Cl. ..... 241/282.1; 241/199.7; 241/DIG. 14; 241/DIG. 33

[51] Int. Cl.[2] ..... B02C 18/12; B02C 18/18

[58] Field of Search ..... 241/199.6, 199.7, 277, 241/282.1, DIG. 14, DIG. 33

[56] References Cited

UNITED STATES PATENTS

| | | | |
|---|---|---|---|
| 2,934,115 | 4/1960 | Grebe | 241/199.6 |
| 3,001,563 | 9/1961 | Karpf | 241/199.7 |
| 3,764,081 | 10/1973 | Seydelmann | 241/199.7 |
| 3,879,000 | 4/1975 | Muller et al. | 241/199.7 X |

*Primary Examiner*—Granville Y. Custer, Jr.
*Assistant Examiner*—Howard N. Goldberg
*Attorney, Agent, or Firm*—Woodhams, Blanchard and Flynn

[57] ABSTRACT

A vacuum food mill or blender for the cutting and mixing of food. There is provided a container associable with means for evacuating same, said container comprising a stationary lower part and a removable cover therefor. A receptacle is rotatably arranged within the container and a cutter spindle associated with suitable drive means projects into the container. Knives for cutting and mixing of the food are mounted on the spindle within the receptacle. The cover comprises two halves which are both mounted on a single hinge shaft, one thereof being pivotal with said shaft and the other thereof being pivotal with respect to said shaft. A rotatable receptacle is mounted within the container for rotation with respect thereto and the drive for same also supports said hinge shaft.

8 Claims, 3 Drawing Figures

VACUUM FOOD MILL

FIELD OF THE INVENTION

The invention relates to a food mill or blender operable under vacuum for cutting and mixing of food, same comprising a container capable of being evacuated and including a stationary lower part and a removable cover, a receptacle rotatably arranged in the container and a cutter spindle projecting into the container, said cutter spindle having knives for cutting and mixing of the food contained in the receptacle.

BACKGROUND OF THE INVENTION

Vacuum cutters have the advantage that the food can be cut and mixed with an air-tight seal. To minimize the entrapment of air in the foods which are to be treated increases their durability, in particular when dealing with easily spoiled foods, such as meat.

It is known from German Patent No. 1,157,502 to incline the plane of separation of the cover and lower part of the container toward the axis of rotation of the receptacle so that its highest point lies above the zone occupied by the cutter spindle. The advantage lies in the cover not being connected to the cutter spindle and the receptacle being capable of easy filling and emptying. Furthermore, only one motor is needed for driving the receptacle and the cutter spindle. In the case of larger vacuum cutters having a receptacle capacity of 500 liters and more, the cover has a diameter exceeding two meters. The cover must be very strong, because it may be subjected to 31,000 kp. and more when the container is evacuated. This requires extremely heavy covers, for which the opening and closing is expensive and time consuming. In known vacuum cutters, this cover is supported swingably on one side of the lower part of the vacuum container. The food is removed and introduced approximately on the side which is opposite the pivot axis of the lid. However, the knives are arranged approximately on the side on which the cover is fastened, so that even when the cover is open the knives can be reached only with difficulty. However, the knives must often be reground so that the difficult accessibility of the knives causes an increase in expense of servicing.

SUMMARY OF THE INVENTION

The basic purpose of the invention is to construct a vacuum cutter of the above-mentioned type so that same can be opened quickly, can be filled and emptied easily and has good accessibility to the knives.

This purpose is attained according to the invention by making the cover of the container of two halves, which are secured on a hinge shaft supported on both sides of the container. The hinge shaft is advantageously arranged in such a manner that the one cover half covers the knives and the other cover half covers the feed and removal point. The cover is constructed in such a manner that the two cover halves assure a tight closure of the container. The advantage of the invention consists, among others, in requiring the lifting of only one cover half for supplying the cutter, which can take place in a substantially simpler and quicker manner than if the cover must be lifted up as a whole. By arranging the hinge shaft in the center of the apparatus, good accessibility of the knives on the cutter spindle is assured.

According to a further suggestion of the invention, the drive for each cover half is arranged in the drive chamber of the device.

To relieve the hinge shaft, same is supported on the center axis of the drive for the receptacle of the apparatus. According to a further suggestion of the invention, a ball head mounted on the center axis serves to support the hinge shaft.

BRIEF DESCRIPTION OF THE DRAWINGS

One exemplary embodiment of the invention will be described more in detail hereinafter in connection with the drawings, in which.

DETAILED DESCRIPTION

Figure 1:
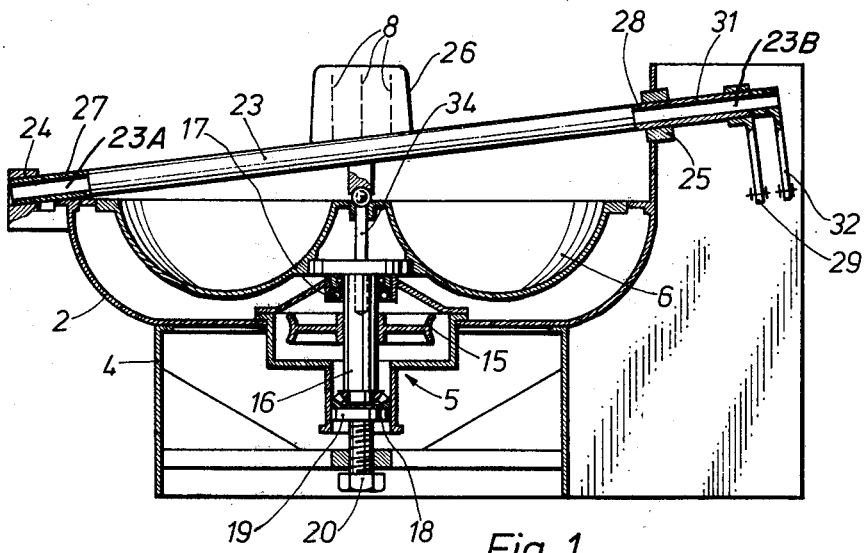
FIG. 1 is a cross-sectional view of a vacuum cutter embodying the invention.
Figure 2:
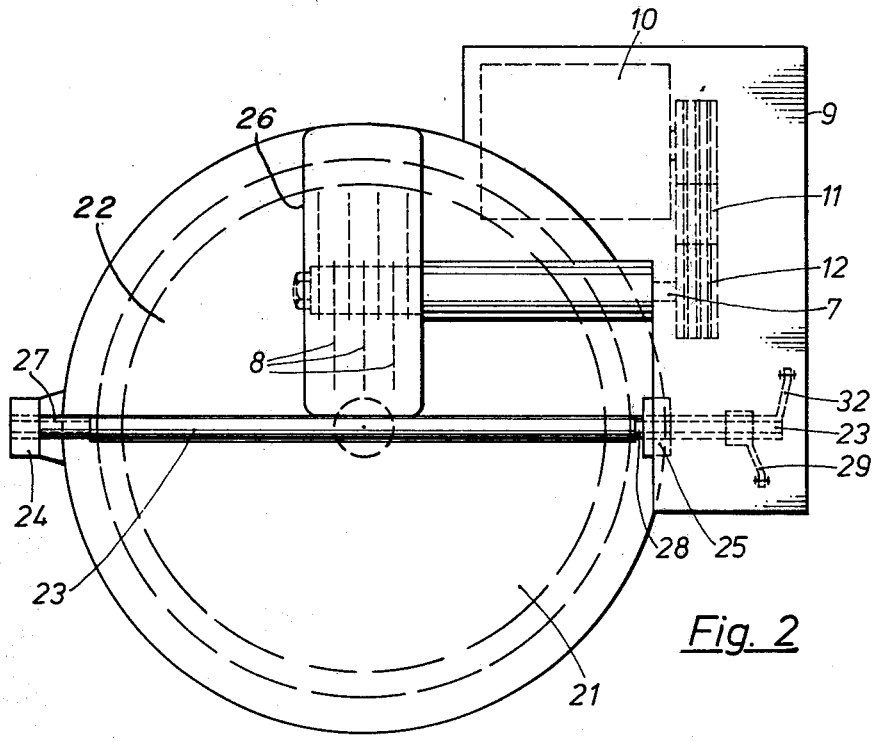
FIG. 2 is a top view of the exemplary embodiment illustrated in FIG. 1.

The vacuum cutter illustrated in the figures consists of a vacuum container 1 which has a lower part 2 and a cover 3. The lower part 2 rests on a frame 4 and receives the drive 5 for the receptacle 6 which is rotatably supported in the vacuum container 1. Conventional means, not shown, are provided for evacuating the container 1 as desired.

A cutter spindle 7 extends through the lower part 2, knives 8 being secured on the forward end of said cutter spindle for cutting food contained in the receptacle 6. A motor 10 is arranged in the drive chamber 9 of the vacuum cutter, which motor drives the cutter spindle through a V-belt 11 and V-belt disk 12.

A worm 14 of the drive 5 for the receptacle 6 is driven through a further V-belt 16 which engages the V-belt disk 13 of the motor. The worm 14 drives a worm gear 15, which is secured on a gear shaft 16. The gear shaft 16 is supported rotatably in the frame 4 by ball bearings 17, 18. The receptacle 6 is connected in rotationally fixed relationship to the shaft 16. The ball bearing 18 on which the gear shaft 16 is supported is supported on a guide plate 19, which in turn is supported by an adjusting screw 20, which latter is mounted in the frame 4. A ball pin 34 is screwed into the gear shaft 16, which ball pin serves to secure the receptacle 6 on the gear shaft.

Figure 3:
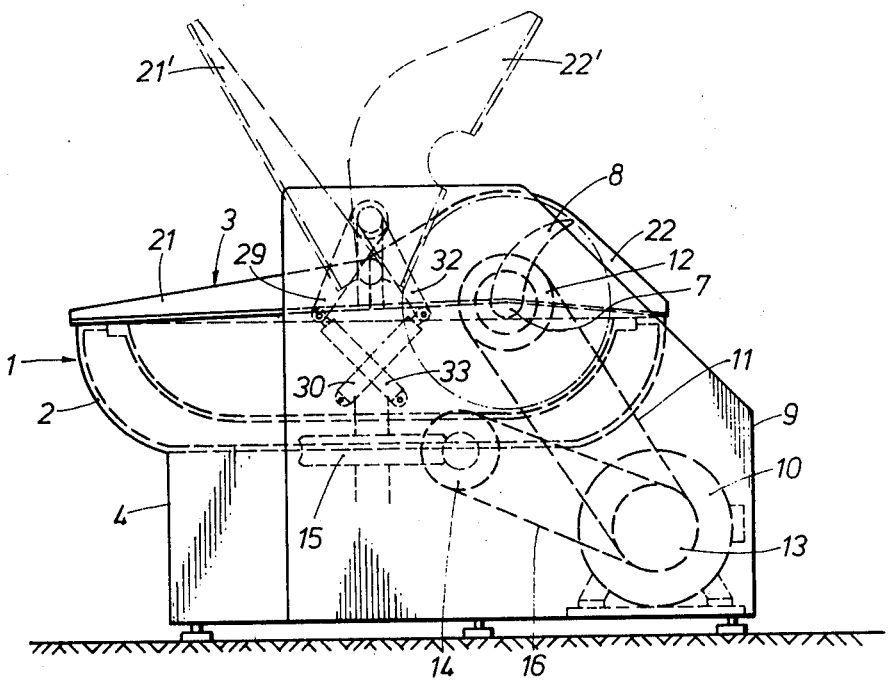
FIG. 3 is a front view of the vacuum cutter illustrated in FIG. 1.

The lower part 2 of the vacuum container 1 is closed by a cover 3, which consists of two halves 21, 22. These two halves are pivotable by means of a hinge shaft 23 which is installed centrally above the lower part 2. The hinge shaft 23 is supported rotatably in bearings 24 and 25 which are secured on the lower part 2. The cover half 22 which covers the knives and has a dome 26 is connected directly to the hinge shaft 23. The other cover half 21 has sleeves 27, 28 at its two ends, which are rotatable on reduced diameter portions 23A and 23B of the hinge shaft 23. Both cover halves 21, 22 are sealed against one another and against the lower part 2. To open the cover half 22, the hinge shaft 23 (including the reduced diameter portions 23A and 23B) are rotated, while for opening the cover half 21 the sleeves 27, 28 rotated on the reduced diameter portions 23A and 23B. Since the sleeves 27 and 28 are connected to the cover half 21, a driving of one sleeve 28 will effect a rotation of the cover half 21 and the other sleeve 27 therewith. The hinge shaft 23, particularly the reduced diameter portion 23B, extends into the drive chamber 9 of the vacuum cutter. A lever 32 is mounted on the end of the hinge shaft 23 and a hydraulic cylinder 30 engages said lever 32. A lever 29 is connected to the part 31 of the sleeve 28, which part extends into the drive chamber 9 and a hydraulic cylinder 33 engages said lever 29. To open and close the cover halves to the broken line positions 21' and 22' illustrated in FIG. 3, the hydraulic cylinders 30, 33, respectively, are supplied with appropriately pressurized liquid.

The hinge shaft 23 is supported in its center on the ball pin 34, through which a portion of the weight of the cover 3, and the atmospheric pressure upon withdrawal of air, are transmitted directly onto the frame 4. This prevents the very heavy cover 3 of the lower part 2 from being deformed. This is very important inasmuch as the knives in the receptacle rotate past one another at a small spacing (some tenths of a millimeter). If the forces were received on the lower part of the vacuum container, such forces would slightly deform same at a normal elasticity for the vacuum container in view of the considerable forces involved, so that the knives could contact the receptacle.

Only the cover half 21 needs to be opened for feeding into and removing food from the vacuum cutter. The cover half 22 is opened only when the knives 8 are to be replaced.

The embodiments of the invention in which an exclusive property or privilege is claimed are defined as follows:

1. In a vacuum food mill or blender for cutting and mixing of food having a vacuum container, means for subjecting same to a source of vacuum, said vacuum container being comprised of a stationary lower part and a removable cover, a receptacle rotatably supported in said vacuum container and a cutter spindle projecting into said vacuum container and having knives thereon for cutting and mixing of the food contained in said receptacle, the improvement comprising wherein said cover of said vacuum container includes hinge means mounted on said lower part and extending transversely over the top of said receptacle and dividing said cover into plural cover sections, each of said cover sections being independently pivotally supported by said hinge means for movement toward and away from said receptacle.

2. The improved vacuum cutter according to claim 1, wherein one cover section includes means defining a hood for said knives.

3. The improved vacuum cutter according to claim 1, wherein said hinge includes a hinge shaft and support means for supporting said hinge shaft on a gear shaft which drives said receptacle for rotation.

4. The improved vacuum cutter according to claim 3, wherein said hinge shaft rests on a ball head mounted on said gear shaft.

5. The improved vacuum cutter according to claim 1, wherein said hinge means divides said cover into two cover halves.

6. The improved vacuum cutter according to claim 1, wherein said hinge means comprises a hinge shaft having plural portions of reduced diameter and being secured to one of said cover sections and hinge sleeves secured to another of said cover sections rotatably mounted on said portions of reduced diameter and drive means for selectively driving said hinge shaft and said hinge sleeves for relative rotation.

7. The improved vacuum cutter according to claim 1, wherein said hinge means includes drive means for selectively driving one or both of said cover halves for pivotal movement toward and away from said receptacle.

8. The improved vacuum cutter according to claim 7, wherein said drive means for each cover section is arranged in a drive chamber adjacent said vacuum container.

* * * * *